United States Patent [19]

Kückens et al.

[11] Patent Number: 4,552,286

[45] Date of Patent: Nov. 12, 1985

[54] METHOD AND AN APPARATUS FOR THE PRODUCTION AND DISPENSING IN PORTIONS OF NONCARBONATED MIXED DRINKS

[75] Inventors: Alexander Kückens, Gross Sarau; Horst Köhl, Bad Oldesloe, both of Fed. Rep. of Germany

[73] Assignee: Dagma Deutsche Automaten und Getrankemaschinen GmbH & Co. KG, Reinfeld, Fed. Rep. of Germany

[21] Appl. No.: 533,860

[22] Filed: Sep. 20, 1983

[30] Foreign Application Priority Data

Sep. 21, 1982 [DE] Fed. Rep. of Germany ..... 3234957

[51] Int. Cl.[4] ..... B67D 5/60

[52] U.S. Cl. ..... 222/145; 239/113; 99/323.1; 426/474; 222/1

[58] Field of Search ..... 222/399, 145, 148, 394, 222/135, 132, 129, 1; 239/113, 427.5, 433, 427.3, 311; 99/323.1, 323.2, 275; 366/101, 191, 184; 426/388, 474

[56] References Cited

U.S. PATENT DOCUMENTS

| | | | |
|---|---|---|---|
| 2,078,013 | 4/1937 | Nutry | 99/323.2 |
| 2,143,817 | 1/1939 | Longdin et al. | 239/427.5 |
| 2,391,422 | 12/1945 | Jackson | 239/427.3 |
| 4,244,821 | 1/1981 | Molvar | 239/113 |
| 4,314,671 | 2/1982 | Briar | 239/427.5 |
| 4,380,308 | 4/1983 | Greenwood | 239/113 |

*Primary Examiner*—H. Grant Skaggs
*Assistant Examiner*—Kenneth Noland
*Attorney, Agent, or Firm*—Karl F. Ross; Herbert Dubno

[57] ABSTRACT

A method and an apparatus are proposed in order to eliminate the influence of viscosity variations in the syrup on the accuracy of metering in vending machines for the production and dispensing of still mixed drinks by considerably raising the injection pressure for the water, to eliminate the effect of the susceptibility of these syrups to spoilage by intentional aeration of the injection zone in the case of mixed drinks based on citrus syrups, and at the same time to keep the pulp particles of the citrus syrup in a desired state of suspension in the prepared mixed drink by intentional introduction of a predetermined quantity of air during the dispensing process, while avoiding foaming and clouding of the mixed drink by intentionally cutting off the introduction of air in the case of mixed drinks based on clear syrups, without the raised injection pressure having to be omitted even with these syrups.

3 Claims, 1 Drawing Figure

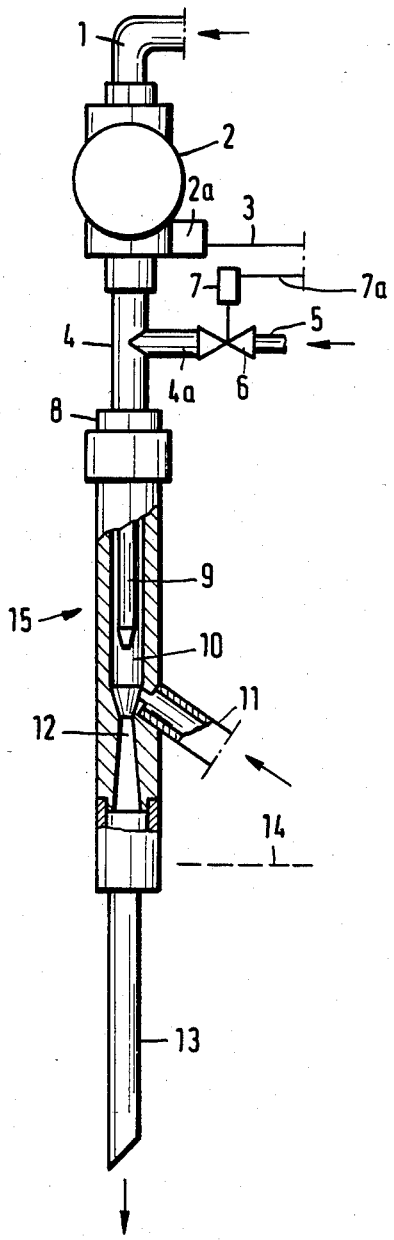
1
2
2a
3
7
7a
5
4
4a
6
8
9
15
10
11
12
14
13

METHOD AND AN APPARATUS FOR THE PRODUCTION AND DISPENSING IN PORTIONS OF NONCARBONATED MIXED DRINKS

FIELD OF THE INVENTION

The invention relates to a method of producing and dispensing portions of noncarbonated (quiescent) mixed drinks from fruit syrup and water in which the fruit syrup is sucked up by a compressed water jet by the injection pump principle, is mixed with the water and the mixture is dispensed.

BACKGROUND OF THE INVENTION

Methods and vending machines for the dispensing in portions of noncarbonated mixed drinks have been known for a long time. The fruit syrup is usually cooled and is mixed with water, usually tap water, directly during the dispensing operation. In vending machines, it is usually possible to choose between noncarbonated mixed drinks of differing flavors. The choice basically lies between the citrus line (lemon, orange, pineapple) and the line of clear drinks based, for example, on apple syrup or the like. The two lines differ essentially in that the citrus line uses syrups or concentrates which also contain a considerable amount of pulp and lead to cloudy drinks, while the other line uses essentially syrups which lead to clear mixed drinks. Moreover, the citrus syrups are very susceptible to spoilage and must therefore be cooled, for example, to between 4° and 5° C.

Another problem in the production of noncarbonated mixed drinks lies is that the viscosity of the syrups and concentrates varies with temperature. As a change in the syrup temperature within certain limits cannot be prevented with a justifiable outlay for cooling, in spite of the cooling, inaccuracies occur in metering and therefore there are variations in the consistency and quality of the mixed drink. These variations cannot be compensated at the normal injection pressure which is predetermined by the line or top pressure and can be at least 1.5 bar.

An elevation in the injection pressure also fails to solve the problem because a high pressure causes foaming and clouding in the case of mixed drinks using syrups in the clear line, so that apple juice as dispensed can give the impression that it is beer.

For this reason, an injection pressure of approximately 1.5 bar has been maintained in the dispensing of noncarbonated mixed drinks in vending machines and attempts have been made to overcome the other problems by additional cooling and control.

OBJECTS OF THE INVENTION

The object of the invention is to remedy these problems and provide a method and an apparatus with whose aid the above-mentioned problems can be overcome, by means of which the accuracy of metering can be made independent of viscosity variations without additional expense, which markedly reduces the risk of spoilage with drinks of the citrus line and which also ensures that cloudiness due to foaming is avoided in the case of noncarbonated mixed drinks.

With pulp-containing syrups, there is also a risk that the pulp particles in the glass in the prepared mixture either settle on the bottom of the glass or float to the surface of the drink. Both situations are undesirable. It is, therefore, another object to ensure that pulp particles of the juice or concentrate are kept in suspension in an almost homogeneous distribution in the liquid content. This should also be achieved by the new method and the corresponding new apparatus.

SUMMARY OF THE INVENTION

These objects are achieved in accordance with the invention whereby with pulp-containing syrups, some air bubbles which keep the particles in suspension are attached to the pulp particles in the injection zone. This prevents the pulp particles from rising to the surface of the liquid or from settling on the bottom of the glass so that the drink maintains its initial approximately homogeneous mixed state even after prolonged standing.

As syrups of the citrus line and syrups of the clear drinks line are usually processed in vending machines, the method for the production and dispensing in portions of noncarbonated mixed drinks of the invention is carried out so that the water is conveyed through the injection zone at a pressure considerably exceeding the normal line pressure and, in the case of syrups which are low in pulp or clear, the injection zone is kept partially filled with the syrup between two dispensing processes and, in the case of syrups which are rich in pulp or cloudy, the injection zone is freed from syrup remains after each dispensing process and is kept partially filled with air and this air is then mixed intensively with the syrup and the relevant quantity of water during the next injection process. Injection pressures of between 1 and 6 bar have proven advantageous.

All problems which formerly occurred due to viscosity variations have essentially been avoided at the raised injection pressure without the need for measures to prevent the actual viscosity variations.

In conjunction with the other measures according to the invention, the raised pressure also causes the quantity of air available while processing syrups of the citrus line to be introduced intensively into the mixture so that this air is attached in very fine bubbles to the pulp particles of the syrup and the processes are controlled in such a way that the pulp particles reach a state of suspension in the prepared mixture in the glass.

The necessary air is provided in a very simple manner by emptying the injection zone of syrup remains after each injection process, these remains being introduced into the mixed drink just dispensed. At the same time, this eliminates the problems usually caused by the susceptibility of the citrus syrups to spoilage. The residual quantities still remaining in the injection metering apparatus after emptying the syrup remains are extremely small and generally are at such a high sugar concentration that problems of hygiene do not arise.

With the almost complete emptying of the injection zone of the citrus syrup, the desired quantity of air is at the same time kept in readiness in an approximately dimensioned injection zone for the next injection process, which air is intensively mixed with the water and the syrup in the injection zone by the water jet introduced under elevated pressure.

However, it is also possible to adopt the elevated water pressure of between 1.5 and 6 bar in the processes for dispensing syrups of the clear syrup line without the formerly feared risk of foaming and clouding of the mixed drink arising. This is achieved without great expense by keeping the injection zone filled with the clear syrup after each injection process in this case. As the clear syrup is considerably less susceptible to spoilage, no additional problems arise as the residual cooling is sufficient for the requirements of hygiene. The filling of the injection zone with syrup prevents air from being injected into the mixture during the next dispensing process in spite of the considerably elevated water pressure. Extremely slight bubbling and therefore virtually no foam and no cloudiness are obtained in spite of dispensing at elevated pressure.

For carrying out the method, the invention uses an apparatus in a vending machine for the production and dispensing in portions of mixed drinks, which is equipped with a water jet injection pump with a connection for water, in particular tap water, and connections for fruit syrup and with an outlet for the mixture downstream of the injection zone. In this apparatus a pump which raises the water pressure above the normal line pressure is arranged upstream of the water connection and the injection zone is provided with a controllable aeration valve. The aeration valve is preferably arranged between the connection for water and the pump and is controllable in such a way that it is closed during each injection process, but is opened before the end of the dispensing process in the case of syrups rich in pulp after closure of the water supply.

Despite its simple structure, the new arrangement operates extremely reliably and allows greatly differing processes during dispensing by the mixing in of air in the case of syrups of the citrus line or clearing of a mixed drink based on clear syrups without great expense, the problems of hygiene in the dispensing of citrus drinks at the same time being solved in a simple manner and the variations in the prepared mixed drink formerly occurring due to viscosity variations being reliably eliminated without great expense.

The term "vending machines" also includes those which operate without coins, which are also known as "dispensers".

BRIEF DESCRIPTION OF THE DRAWING

The invention is described in more detail below with reference to a schematic drawing of an embodiment.

The sole FIGURE shows the apparatus for carrying out the method in a side view which is partially cut away to allow inspection of the injection zone.

SPECIFIC DESCRIPTION

The apparatus can be arranged in a vending machine and can be identical in design for the dispensing of drinks based on citrose syrups and based on clear syrups.

The apparatus can be connected to a conventional water pipe at 1. The water is therefore supplied at the conventional water pressure according to the arrow. However, the water can also be stored substantially pressure-free in a water collecting tank in the vending machine and be removed as required. A pump 2 which raises the pressure of water above the normal line pressure to a pressure of between 1.5 and 6 bar is arranged in the supply pipe 1. The water at the elevated pressure is conveyed via a pipe section 4 to the connection 8 of a water jet injection pump 15. The tube of the water jet pump is shown cut away so as to give a view of the interior. The jet tube 9 through which the water jet is conveyed through the injection zone 10 into the nozzle 12 is shown. The cross-section widens downstream of the nozzle 12. The dispensing tube 13 from which the mixture is conveyed along the arrow into a beaker or the like is shown at the bottom end. The suction tube 11 for the syrup which is supplied as represented by an arrow from a cooled device (not shown) for the syrup opens obliquely from below into the injection zone 10.

The pump 2 which elevates the water pressure can be connected via a switching device **2*a* and a pipe 3** to a central control device on the vending machine.

In the example illustrated, the intermediate pipe 4 has a branch **4*a* which is connected via a valve 6 which can be controlled by an electromagnet 7 to a fitting 5 which communicates along the arrow with the surrounding air. The solenoid can also be connected via a pipe 7*a*** to the central control unit of the vending machine.

If the apparatus illustrated is used for dispensing mixed drinks based on citrus syrups, the syrup is sucked by the water jet via the pipe 11, mixed intensively with the water in the injection zone 10 and conveyed through the nozzle 12 into the dispensing tube 13. At the end of the dispensing process, for example, the pump 2 is stopped via the central control device and the water supply therefore terminated. At the same time, the aeration valve 6 is opened via the electromagnet 7 so that the injection zone 10 can be freed from the syrup remains and the water remains via the discharge tube 13 by running empty. These remains are entrained into the delivered portion. When the next dispensing process is triggered, the valve 6 is closed and the pump 2 started up so that only the quantity of air in the actual apparatus is mixed intensively into the mixture of water and syrup with the starting injection process. The air is broken down into very fine bubbles and attaches itself to the pulp particles of the citrus syrup. The quantity of air is calculated in such a way, in conjunction with the elevated water pressure, that the pulp particles in the prepared mixed drink are kept in suspension through the attached bubbles for a prolonged period.

When using the apparatus for dispensing mixed drinks based on clear syrups, the arrangement is controlled in such a way that, at the end of the dispensing process, the syrup sucked through the water jet in the injection zone 10 and the subsequent nozzle 12 remains approximately at the level of the line 14. Delivery is not possible since aeration of the interior of the apparatus does not take place. The injection zone 10 and the connected internal volume of the apparatus therefore remains filled with liquid so that no air is present. This state is maintained until the next dispensing process, which also takes place at the elevated water pressure through the pump 2. As no significant quantities of air are present, bubbles cannot be produced and foaming and therefore clouding of a mixed drink cannot occur.

Depending on the quantity of air required for producing the state of suspension of the pulp, the point where the aeration valve 16 is attached to the apparatus can be higher or lower. It can also be attached directly to the housing tube of the water jet injection device 15.

It is thus possible to determine the quantity of air which is introduced into the mixed drink during the injection process according to the selected injection pressure of the water and pulp content or type of pulp, so that the desired state of suspension can be achieved in a simple manner for each type of syrup.

Viscosity variations have no effect as they are compensated by the correspondingly elevated water pressure and therefore injection pressure.

The new apparatus can also be fitted subsequently on to earlier devices based on the injection principle, as the interposition of a pump which raises the pressure and the installation of the aeration device can usually be carried out later on without difficulty.

We claim:

1. In a method of dispensing noncarbonated beverages, in which water is forced through an injection pump and a citrus concentrate is drawn by the injection pump into admixture with the water, the improvement which comprises the steps of:

following a discharge of said mixture to form a portion of a beverage dispensed, terminating the flow of water and admitting air to said ejection pump to completely discharge an injection zone thereof from said concentrate; and maintaining air in said zone so that the air is encountered by said mixture for the formation of the next portion of the mixture to be dispensed and air bubbles are formed in said mixture to hold particles of said concentrate in suspension in the water of the mixture.

2. A method of dispensing noncarbonated mixed beverages which comprises the steps of:

(a) pumping water at a pressure of substantially 1.5 to 6 bar into and through an injection pump having an injection zone in which mixing can occur and terminating the pumping of the water upon the delivery of a portion of a mixed beverage formed in said zone;

(b) selectively admitting to said zone under suction induced by said injection pump a suspension concentrate adapted to form a beverage in which particles are suspended in the water, and a clear syrup adapted to be mixed with water in said zone to form selectively a suspension beverage and a clear beverage;

(c) for the production of a suspension beverage, admitting air to said zone immediately following the termination of pumping of said concentrate into the portion of the beverage previously formed in said zone, and maintaning air in said zone so that each subsequent mixture for the production of such suspension beverage will encounter the air retained in said zone and mix intensively therewith so that air bubbles in said suspension beverage hold said particles in a state of suspension in the water thereof; and (d) for the preparation of said clear beverage substantially completely filling said zone with said syrup whereby foaming of said clear beverage is precluded.

3. An apparatus for use in a vending machine and dispenser for producing a noncarbonated mixed drink comprising in combination:

a pressure pump adapted to supply water at a pressure of 1.5 to 6 bar;

an injection pump connected to said pressure pump and traversed by said water at said pressure, said injection pump having a zone in which said water can mix to form said beverage;

means for connecting a source of a citrus concentrate to said zone whereby said citrus concentrate is induced by suction from said injection pump into said zone to mix with said water and form said beverage, said zone opening downwardly to dispense said beverage;

an aeration duct connected with said pump upstream of said zone and between said zone and said pressure pump; and an aeration valve in said aeration duct for admitting air through said duct into said zone upon the termination of pumping of said pressure pump whereby said zone is voided of said beverage in a previous portion thereof and air is maintained in said zone to encounter the mixture of a second portion of said beverage and is mixed intensively with said concentrate during a subsequent portion to suspend particles of said concentrate in the water.

* * * * *